US008333445B2

(12) United States Patent
Schnell

(10) Patent No.: US 8,333,445 B2
(45) Date of Patent: Dec. 18, 2012

(54) ASSEMBLY ADAPTOR

(75) Inventor: Juergen Schnell, Lohmar (DE)

(73) Assignee: Huwil Butoripari Es Uzletberendezesi Rendszerek Kft, Budapest (HU)

( * ) Notice: Subject to any disclaimer, the term of this patent is extended or adjusted under 35 U.S.C. 154(b) by 497 days.

(21) Appl. No.: 12/428,725

(22) Filed: Apr. 23, 2009

(65) Prior Publication Data

US 2009/0267473 A1 Oct. 29, 2009

(30) Foreign Application Priority Data

Apr. 25, 2008 (DE) ..... 20 2008 005 795 U

(51) Int. Cl.
*A47B 97/00* (2006.01)

(52) U.S. Cl. ..... 312/327

(58) Field of Classification Search ..... 312/294, 312/326, 327, 328, 329, 352, 265; 16/365, 16/366, 382, 82; 248/214, 276.1, 284.1
See application file for complete search history.

(56) References Cited

U.S. PATENT DOCUMENTS

| | | | | |
|---|---|---|---|---|
| 4,485,524 | A * | 12/1984 | Neville | 16/241 |
| 5,079,797 | A * | 1/1992 | Ohshima et al. | 16/82 |
| 5,117,587 | A * | 6/1992 | Doan | 49/495.1 |
| 6,877,830 | B2 * | 4/2005 | Salice | 312/327 |
| 2009/0261696 | A1 * | 10/2009 | Hollenstein et al. | 312/327 |

* cited by examiner

*Primary Examiner* — James O Hansen
(74) *Attorney, Agent, or Firm* — Harness, Dickey & Pierce, P.L.C.

(57) ABSTRACT

An assembly adaptor (6) for the assembly of a functional mounting (19) that is attachable on a cabinet body (1) with a frame (2) structure has an assembly plate (7) with an assembly face (14) on which the functional mounting (19) is attached. A first attachment face (9), in the mounted condition of the assembly adaptor (6), is held in abutment to a frame (2) of a cabinet body (1). An attachment part (8) with a second attachment face (10), in the assembled condition of the assembly adaptor (6), is held in abutment to a side wall (3) of the cabinet body (1). The attachment portion (8) is retainable relative to the assembly plate (7) with a variable distance between the two attachment faces (9, 10).

11 Claims, 10 Drawing Sheets

ASSEMBLY ADAPTOR

CROSS-REFERENCE TO RELATED APPLICATION

This application claims priority to German Patent Application No. 202008005795.7 filed Apr. 25, 2008, which application is herein expressly incorporated by reference.

FIELD

The disclosure relates to an assembly adaptor to attach a functional mounting on a cabinet body in a frame construction.

BACKGROUND

In furniture that is manufactured by a frame construction, a frame, which extends essentially along the edges of the cabinet body, forms a stabilizing base for the cabinet body. On the frame, side walls are attached that are formed thinner than the frame and have only a small stabilizing function, however, not a carrying function. Since the frame is formed thicker than the side wall, the frames project inwards over the inner faces of the side walls. In this case, the opening of the cabinet body that is closed by a lid is formed by the frame. Thus, difficulties in the assembly of functional mountings, especially lid stays, result on the side walls of such furniture pieces. This can be attributed to the fact that an offset from the frame to the side wall is produced. Functional mountings with a flat attachment face cannot be attached without problems.

SUMMARY

Thus, it is an object of the present disclosure to provide an assembly adaptor that enables functional mountings with flat attachment faces to be mounted on a cabinet body in a frame construction where the functional mounting ends flush with the front edge of the cabinet body.

The object is solved by an assembly adaptor that is attachable on a cabinet body in frame structure for the assembly of a functional mounting. The assembly adaptor comprises an assembly plate with an assembly face. The functional mounting is attachable to the assembly plate. A first attachment face, in the mounted condition of the assembly adaptor, is held in abutment with a frame of a cabinet body. An attachment part with a second attachment face, in the assembled condition of the assembly adaptor, is held in abutment with a side wall of the cabinet body. The attachment part is retainable relative to the assembly plate. A variable distance is achievable between two attachment faces.

In a first embodiment of such an assembly adaptor, a connection element is pivotably connected to the assembly plate around a first pivot axis and is pivotably connected to the attachment part around a second pivot axis. Thus, the attachment part can be pivoted relative to the assembly plate, so that the distance of the two attachment faces relative to each other can be varied. As soon as the assembly adaptor is mounted on the cabinet body, no pivoting of the connection element is possible. In this case, the assembly plate is supported via the connection element on the attachment part. In this case, the two pivot axes are arranged parallel to each other. In the assembled condition of the assembly adaptor, the attachment faces are arranged parallel and distanced or spaced to each other. In a second embodiment of the assembly adaptor, the attachment part is detachably connected to the assembly plate. Here, the attachment part may be detachably connected by at least one screw connection to the assembly plate. It can be adjustably connected concerning the distance between the two attachment faces. Preferably, the assembly plate has a first connection web that is arranged in abutment to a second connection web of the attachment part. The connection webs are connected to each other via the at least one screw connection.

To ensure adjustability, an elongated hole is provided in one of the connection webs. The other connection web has a threaded bore. A locking screw is screwed through the elongated hole into the threaded bore.

The assembly plate has a third attachment face to facilitate the attachment of the assembly plate onto the frame. The third attachment face is arranged at a right angle to the first attachment face. In the assembled condition of the assembly adaptor, the third attachment face is held in abutment with the frame.

An additional plate can be provided to provide a larger assembly face. This design enables the assembly adaptor to accommodate different functional mountings, such as lid stays for lids hinged on the body and lid stays for lids not hinged on the body. The additional plate is preferably detachably connected to the assembly plate.

In this case, the additional plate can have a fourth attachment face. The fourth attachment face is arranged on one plane with the first attachment face. In the assembled condition of the assembly adaptor, the fourth attachment face is held in abutment with the frame. Preferably, the assembly plate and the attachment part are parts formed from a sheet metal.

The object is further solved by a cabinet body with an assembly adaptor. The cabinet body has a frame with side walls attached to the frame. The assembly plate is connected to the frame and the first attachment face, facing inwards, is held in abutment to a first inner face of the frame. The attachment part is connected to the side wall. The second attachment face is held in abutment to a second inner face of the side wall, arranged parallel and with a distance to the first inner face.

In this case, an additional plate can be provided. The additional plate is provided for the assembly of a further component of a functional mounting. The additional plate is connected, especially detachably connected, to the assembly plate. The additional plate is connected to the frame and the fourth attachment face is held in abutment with the first inner face of the frame.

On the assembly face of the assembly plate, a functional mounting, such as a lid stay, is mounted. Here, the assembly face is arranged parallel to the second inner face of the side wall.

Generally, the assembly adaptor can be used in wardrobes that have no side walls arranged parallel and opposite to each other. The side walls are arranged at an angle to each other, as is the case in corner units. The side walls enclose the front side or the closed lid of the furniture piece at an angle of above 90°. In this case, however, it is important in order for a trouble-free function to displace the lid, that the assembly face is arranged at a right angle to the front of the furniture piece, relative to the lid. The assembly adaptor according to the disclosure can be attached in this case, such that the assembly face is arranged at a right angle to the lid even though the side wall is arranged at an angle of more than 90° to the lid.

Further areas of applicability will become apparent from the description provided herein. The description and specific examples in this summary are intended for purposes of illustration only and are not intended to limit the scope of the present disclosure.

DRAWINGS

Preferred embodiments of the disclosure are described in detail in the following using the drawings.

DETAILED DESCRIPTION

Figure 1:
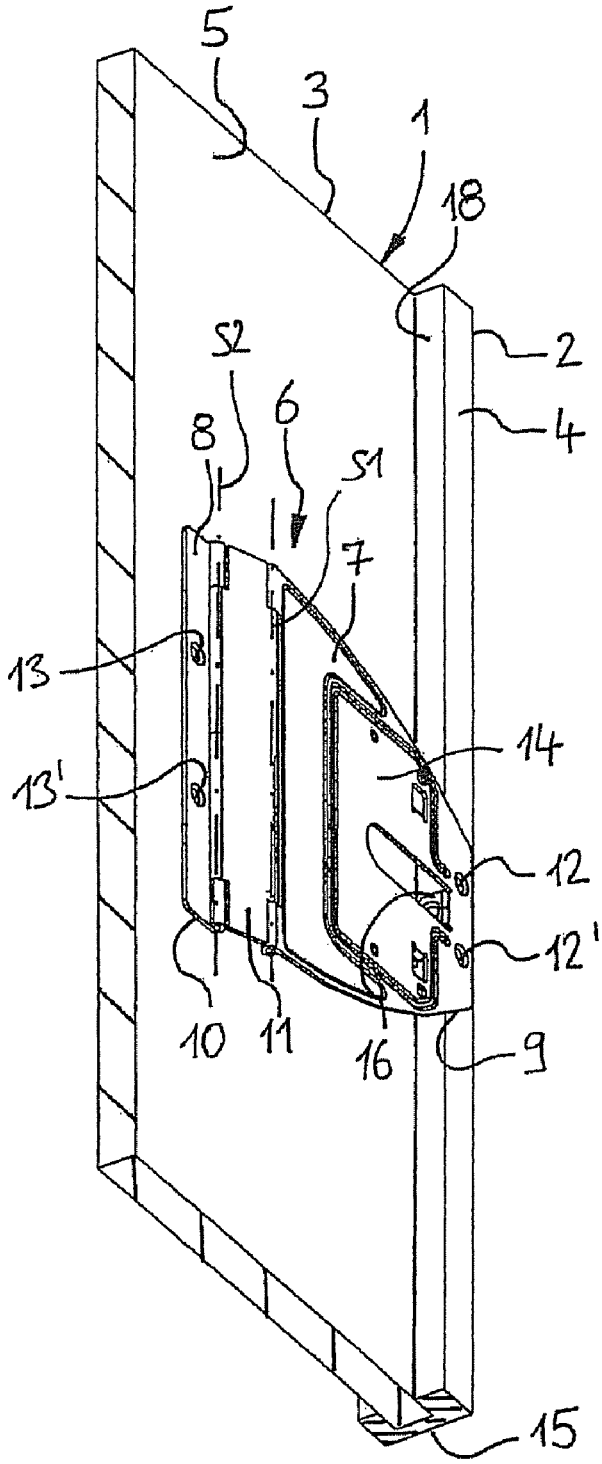
FIG. 1 is a perspective view of a first embodiment of an assembly adaptor on a side wall of a body.
Figure 2:
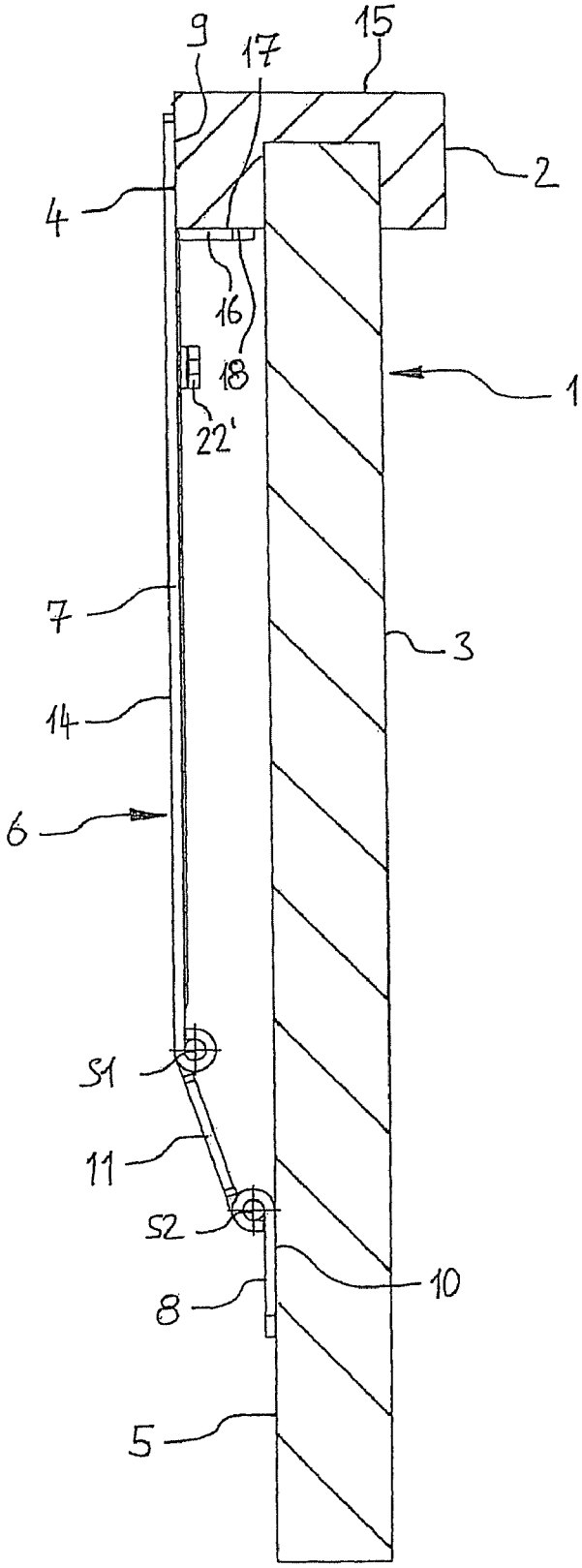
FIG. 2 is a side view of the assembly adaptor of FIG. 1.
Figure 3:
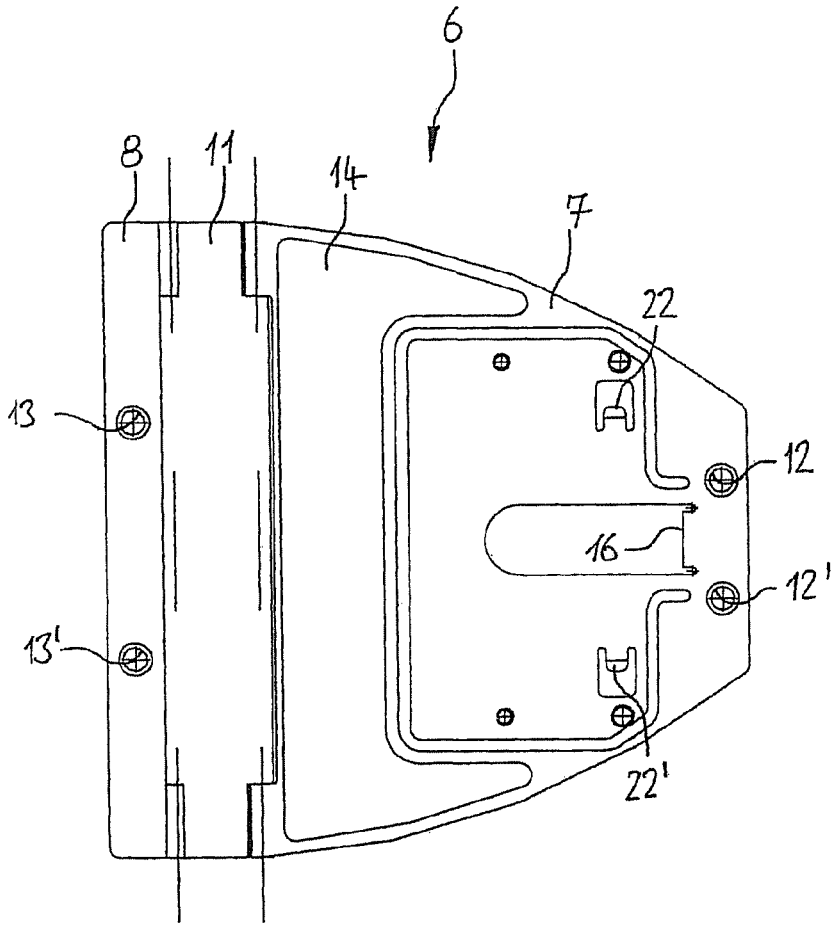
FIG. 3 is a top plan view of the assembly adaptor of FIG. 1.

FIGS. 1 to 3 illustrate a first embodiment of an assembly adaptor 6 according to the disclosure in different representations, and are described together in the following. FIG. 1 illustrates a part of a cabinet body 1 with a frame 2 and a side wall 3. The cabinet body 1 is formed in a frame construction. The frame 2 serves as a stabilizing base structure.

Several side walls 3, made from plates, are attached to the frame 2. The side walls 3 are formed thinner than the frame 2. The side walls 3 are not exposed to high loadings and have no carrying function. In this case, when seen in a thickness direction of the side walls 3, the frame 2 projects over the inner surfaces of the side walls 3. For a cabinet body that is not constructed in a frame construction, but is mounted on self-carrying side walls that ensure the stability of the body, functional mountings have a flat attachment face that abut an inner face of the side wall.

The present disclosure provides for the assembly adaptor 6 to enable use of such functional mountings in cabinet bodies that are constructed in a frame construction. In a cabinet body 1 with a frame construction, the frame 2 forms the opening of the cabinet body, closable by a lid or similar element, so that functional mountings, such as lid stays or flap stops, cannot be mounted on the cabinet body 1 in such a way that they end flush, facing outwards, with an end face 15 of the frame 2.

The assembly adaptor 6 includes an assembly plate 7 attached to the frame 2 in the open area of the cabinet body. The assembly adaptor 6 includes an attachment part 8 that is connected to the side wall 3. The assembly plate 7 has a first attachment face 9, facing inwards, that is held in abutment with a first inner face 4 of the frame 2. The assembly plate 7 includes first attachment bores 12, 12' that pass through the assembly plate 7 and end at the first attachment face 9. Screws can be passed through the attachment bores 12, 12' and screwed into the frame 2, preferably manufactured from wood. Generally, however, other attachment means, such as adhesive tapes or similar, can be provided.

The attachment part 8 has a second attachment face 10, facing inwards, that is held in abutment with a second inner face 5 of the side wall 3. The attachment part 8 includes attachment bores 13, 13' that end at the second attachment face 10. Screws are passed through the attachment bores 13, 13' and are screwed into the side wall 3. The side wall 3 is also preferably also manufactured from wood. Also here, other attachment means known to those in the art can be provided, like adhesion connections or the like.

As already explained above, the frame 2 projects over the side wall 3 in its thickness direction. The first inner face 4 of the frame 2 and the second inner face 5 of the side wall 3 are arranged parallel and at a distance to each other. Thus, in the assembled condition of the assembly adaptor 6, the first attachment face 9 and the second attachment face 10 are arranged parallel and at a distance to each other. In different cabinet bodies, the distance between the two inner faces 4, 5 can be different. The assembly adaptor 6 is variable. The attachment part 8 is fixable relative to the assembly plate 7 so that it accounts for a variable distance between the second attachment face 10 and the first attachment face 9 on the cabinet body 1.

The assembly plate 7 includes a connection element 11 to account for the variable distance. On one side, the connection element 11 is pivotably connected to the assembly plate 7 and on the other side it is pivotably connected to the attachment part 8. The connection element 11 is pivotably connected around a first pivot axis S1 to the assembly plate 7 and is pivotably connected around a second pivot axis S2, arranged parallel to the first pivot axis S1, to the attachment part 8. Thus, the attachment part 8 can be pivoted around the pivot axis S1 relative to the assembly plate 7 so that the distance of the attachment part 8 to the plane of the first attachment face 9 of the assembly plate 7 can be varied. To additionally ensure that the second attachment face 10 of the attachment part 8 is aligned parallel to the first attachment face 9, the attachment part 8 can be pivoted around the second pivot axis S2 relative to the connection element 11 and thus, to the assembly plate 7 and can be correspondingly aligned.

The assembly plate 7 has an assembly face 14 to attach the functional mounting. The assembly face 14 is arranged in the assembled condition parallel to the second inner face 5 of the side wall 3. Furthermore, the assembly face 14 is provided facing away from the first attachment face 9, parallel thereto on the assembly plate 7.

An abutment, in the form of a web 16, is provided on the assembly plate 7 to facilitate assembly. The web 16 forms a third attachment face 17. The third attachment face 17 is arranged at a right angle to the first attachment face 9. The third attachment face 17 is held in abutment to a third inner face 18 of the frame 2. The third inner face 18 is arranged at a right angle to the first inner face 4. It is provided in the transition from the first inner face 4 of the frame 2 to the second inner face 5 of the side wall 3. The web 16 can be connected by a screw to the frame 2 via a third attachment bore 37.

Figure 4:
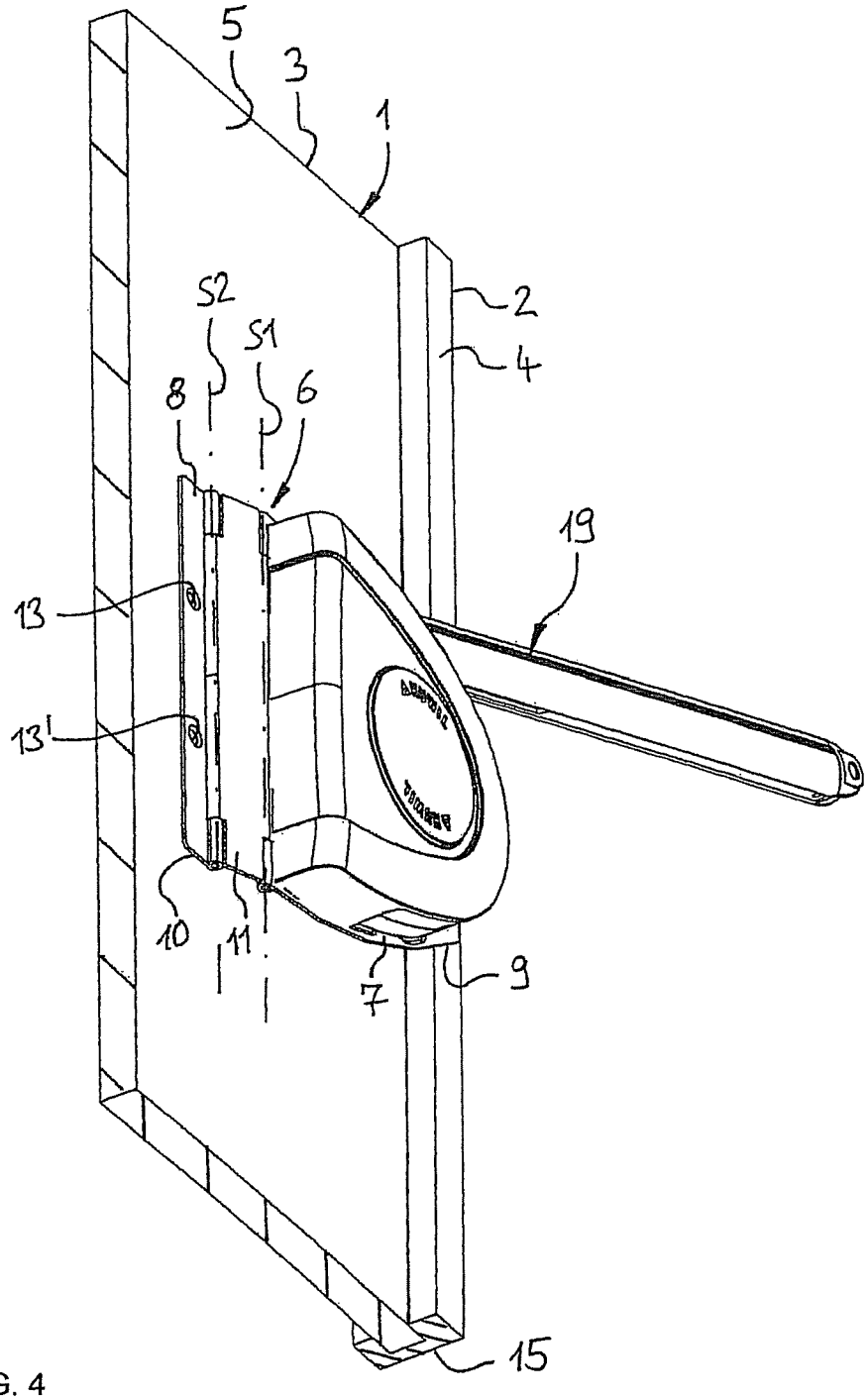
FIG. 4 is a perspective view representation according to FIG. 1 with a functional mounting, mounted on the assembly adaptor.
Figure 5:
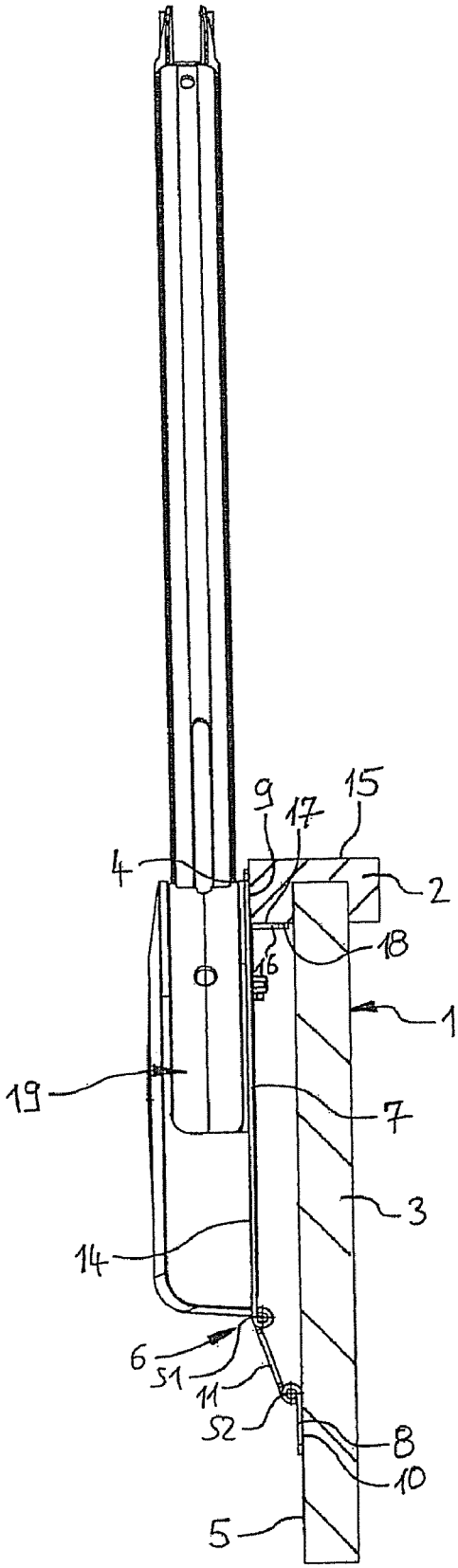
FIG. 5 is a side view according to FIG. 2 with a functional mounting attached to the assembly adaptor.

FIGS. 4 and 5 clarify the function of the assembly adaptor 6 by illustrating a functional mounting in form of a lid stay 19. The lid stay 19, by means of the assembly adaptor 6, is attached to a side wall 3 of the cabinet body 1.

Figure 6:
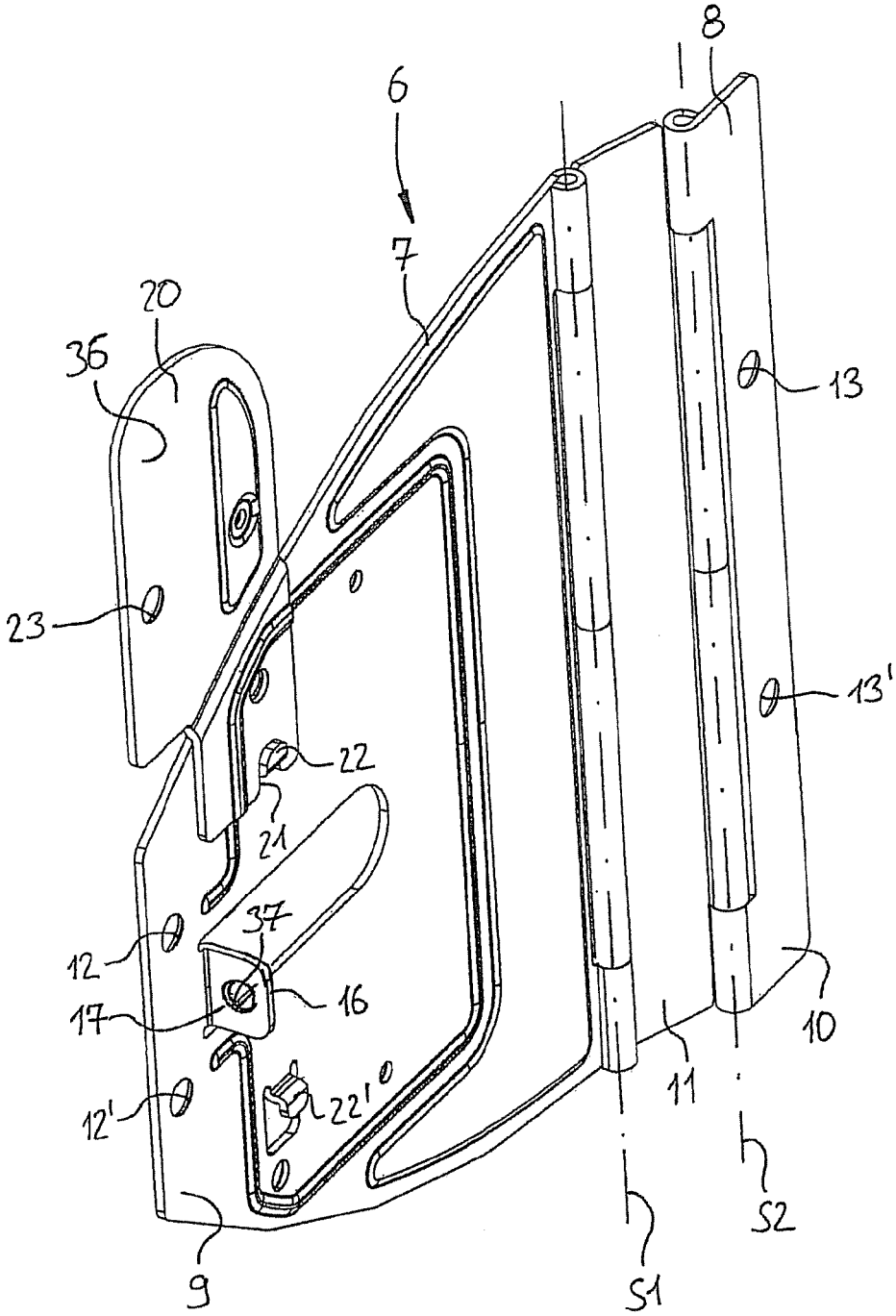
FIG. 6 is a perspective rear view of the assembly adaptor according to FIG. 1 with an additional plate.

FIG. 6 shows the assembly adaptor 6 according to FIGS. 1 to 5 in a rear view. The assembly plate 7 has an additional plate 20 attached to it. The plate 20 abuts the rear side of the assembly plate 7 and has a recess 21. An attachment hook 22 of the assembly plate 7 engages the recess 21 and encompasses the same. Thus, the additional plate 20 is held in a direction transverse to the assembly plate 14. Furthermore, the additional plate 20 has a fourth attachment bore 23, by means of which the additional plate 20 can be screwed to the frame 2. The additional plate 20 has a fourth attachment face 36 that is arranged on a common plate with the first attachment face 9. In the assembled condition of the assembly adaptor 6, the additional plate 20 is held in abutment with the first inner face 4 of the frame 2. Thus, the additional plate 20 is detachably connected to the assembly plate 7. Also, it is rigidly connectable to the frame 2. Further components of a functional mounting may be mounted on the additional plate 20. For example, a rotating connecting rod may be connected to the additional plate 20. The rotating connecting rod is part of a lid stay that is used to pivot a lid that is not connected via a hinge to the body.

Figure 7:
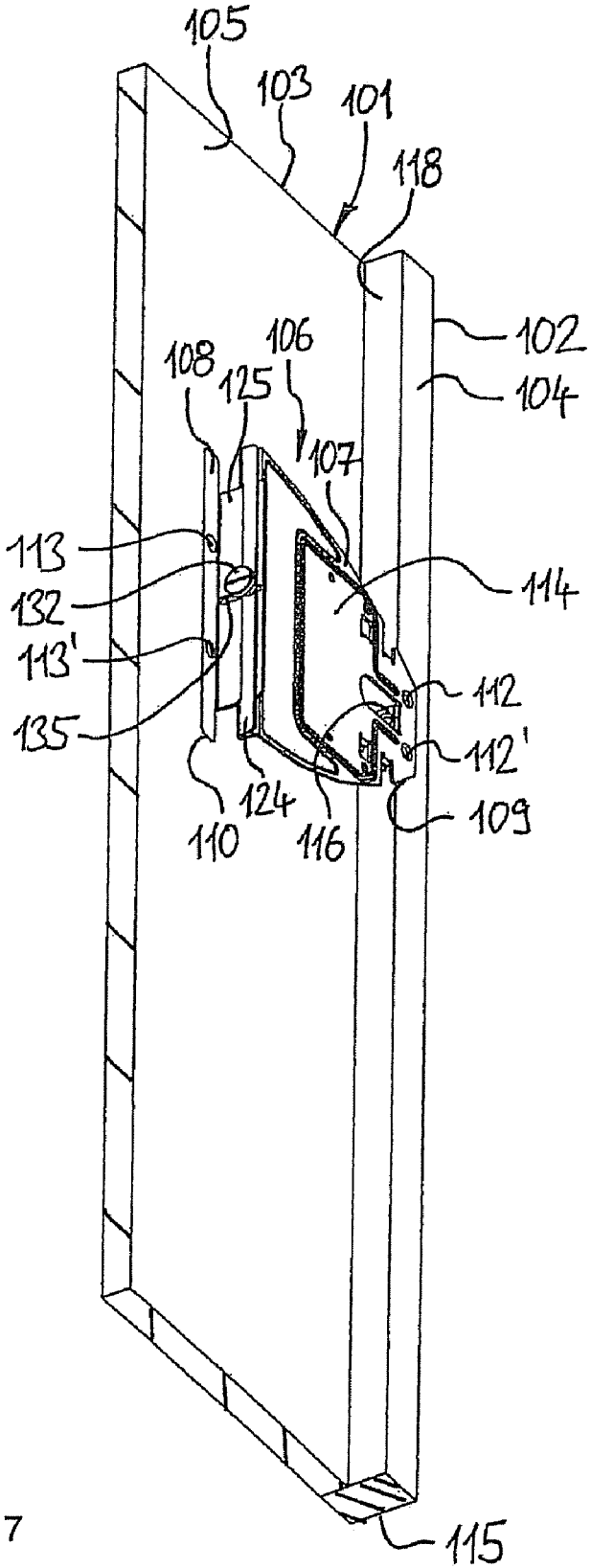
FIG. 7 is a perspective view representation of a second embodiment of an assembly adaptor on a side wall of a cabinet body.
Figure 9:
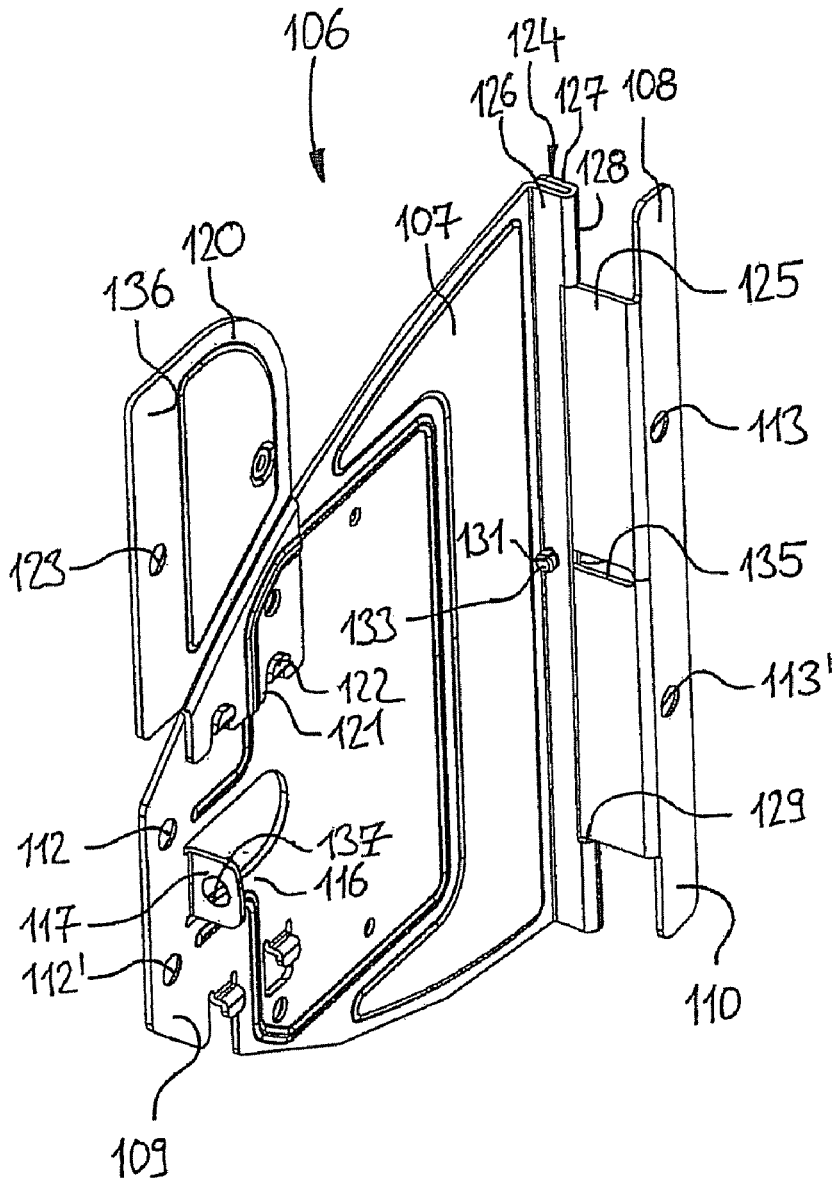
FIG. 9 is a rear perspective view of the assembly adaptor according to FIG. 7 with an additional plate.
Figures 10A, 10B, 10C, 10D:
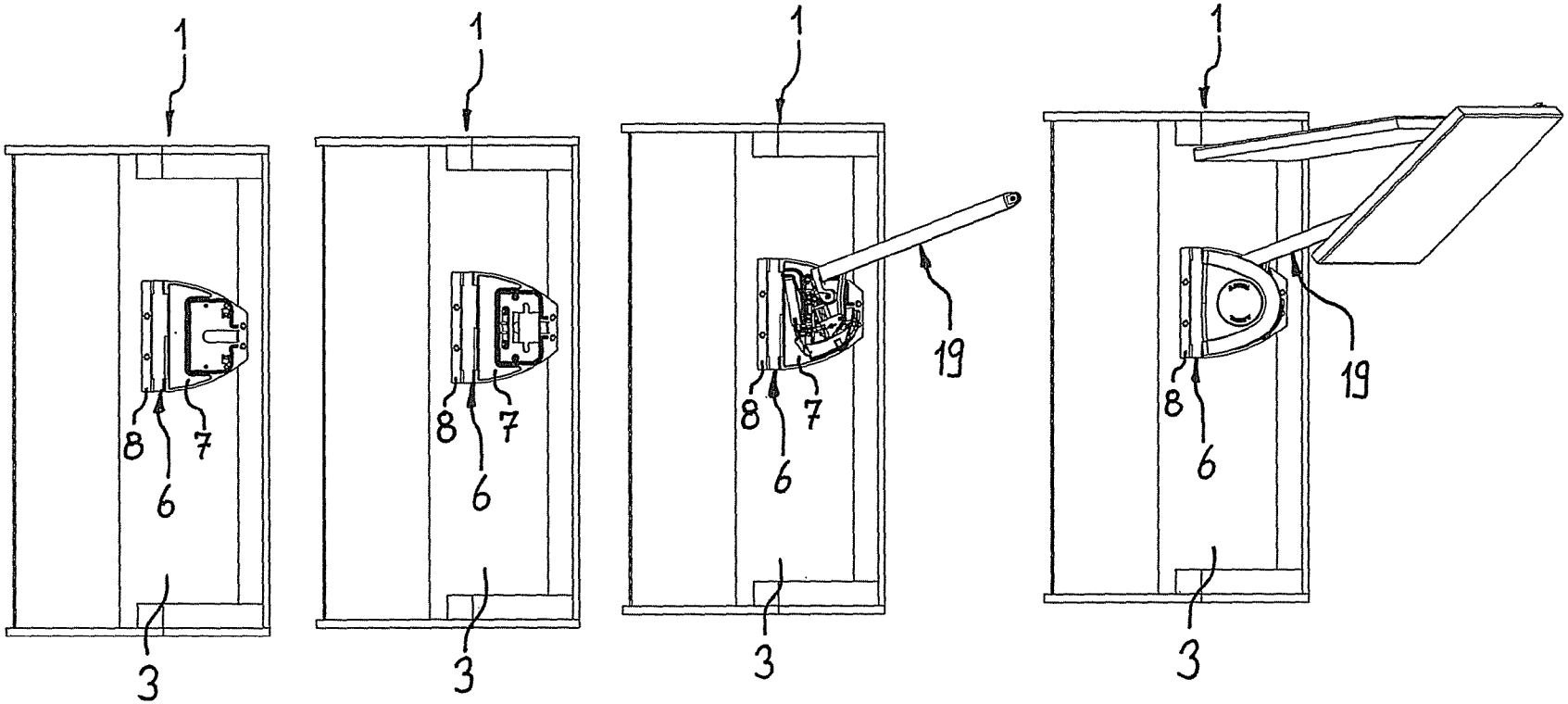
FIGS. 10A-10D are schematic views of the assembly adaptor of FIGS. 1-5 assembled in a cabinet body.
Figures 11A, 11B, 11C, 11D:
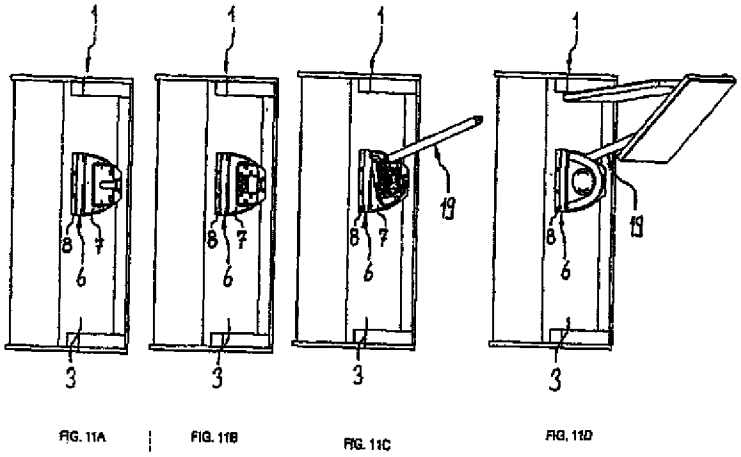
FIGS. 11A-11D are schematic views of the assembly adaptor of FIG. 6 assembled in a cabinet body.

FIGS. 7 and 9 show a second embodiment of an assembly adaptor 106 according to the disclosure. Components that correspond to the components of the first embodiment are provided with reference numerals that are increased by the numerical value 100. Concerning these components, reference is made to the description of the first embodiment.

Figure 8:
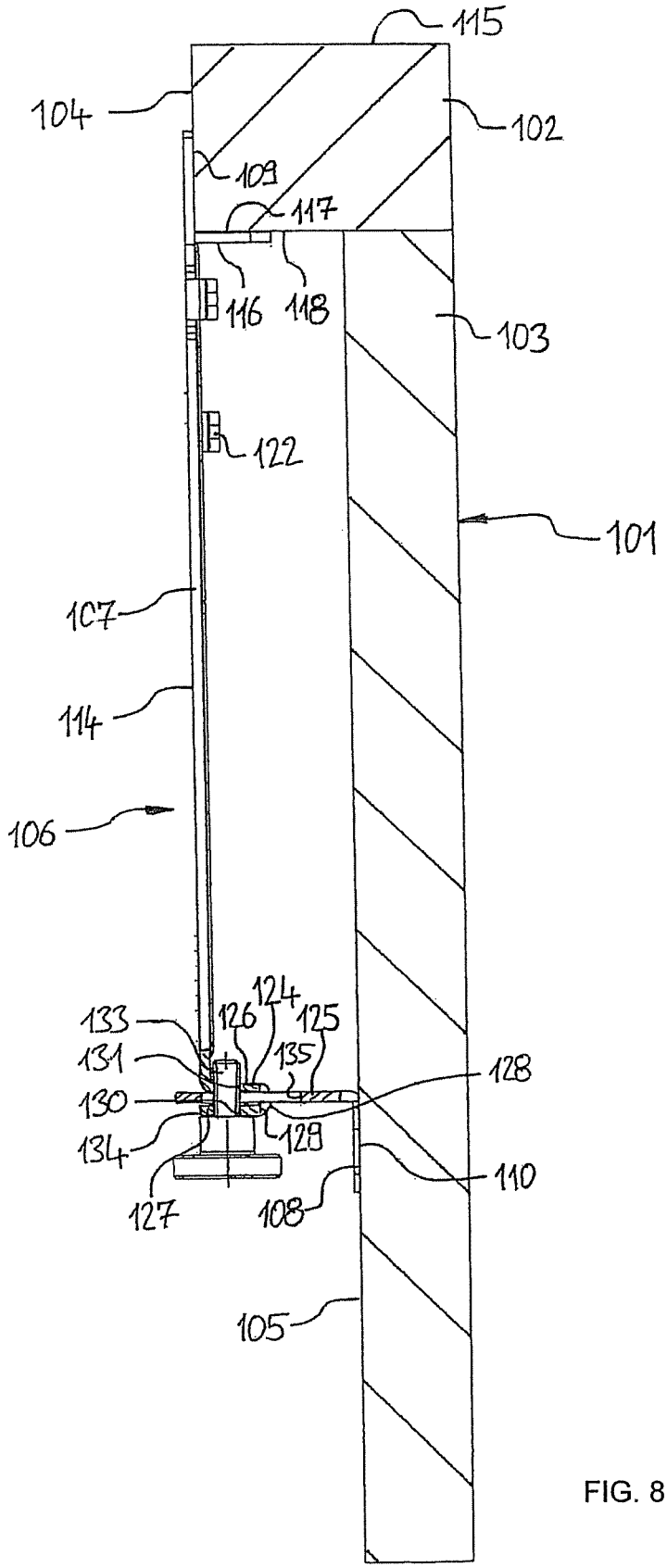
FIG. 8 is a side view of the assembly adaptor according to FIG. 7.

The second embodiment of the assembly adaptor 106 differs from the first embodiment by the connection element. The assembly plate 107 has a first connection web 124. The attachment part 108 has a second connection web 125. The two connection webs 124, 125 are detachably connected to each other. The first connection web 124, when viewed in cross-section, especially visible in FIG. 8, is formed with a U-like shape. The first connection web 124 has a first leg 126 and a second leg 127 arranged parallel to it. They are connected to each other by a web or connection leg 128. A slot 129 is provided in the connection leg 128. The second connection web 125 is passed through slot 129 so that a part of the second connection web 125 is arranged between the first leg 126 and the second leg 127. A threaded bore 131 is provided in the first leg 126. The threaded bore 131 is aligned with a bore 130 in the second leg 127. A locking screw 132, with a threaded portion 133, is screwed into the threaded bore 131. The threaded portion 133 is, in this case, passed through the bore 130 and screwed into the threaded bore 131. The locking screw 132 is supported by a shoulder 134 on the side of the second leg 127 that faces away from the first leg 126. Thus, by screwing the locking screw 132 into the threaded bore 131, the first leg 126 and the second leg 127 are pulled towards each other and clamp the second connection web 125 between the two legs 126, 127. Thus, a secure detachable connection between the first connection web 124 and the second connection web 125 and, thus, between the attachment part 108 and the assembly plate 107 is ensured. To adjust the distance between the first attachment face 109 and the second attachment face 110, the second web 125 has an elongated hole 135. Thus, the attachment part 108 may be displaced along the elongated hole relative to the assembly plate 107 when the locking screw 132 is partially loosened. However, generally also other detachable connections may be considered.

Furthermore, the assembly adaptor 106 has attachment hooks 122, as were already shown concerning the first embodiment of the assembly adaptor. Thus, as visible in FIG. 9, an additional plate 120 may be connected to the assembly plate 107 (FIG. 9) like that illustrated in FIG. 6.

FIGS. 10A-10D and FIGS. 11A-11D illustrate assembly of the assembly adaptor of FIGS. 1-5 and FIG. 6, respectively, into a cabinet body 1.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An assembly adaptor for the assembly of a functional mounting on a cabinet body in frame structure, comprising:

an assembly plate having an assembly face and a first attachment face, said assembly face mounts the functional mounting and said first attachment face, in the mounted condition of the assembly adaptor, is held in abutment with a frame of the cabinet body;

an attachment part with a second attachment face, said second attachment face, in the assembled condition of the assembly adaptor, is held in abutment with a side wall of the cabinet body, and said attachment part is retainable relative to the assembly plate with a variable distance of the two attachment faces to each other; and a connection element, said connection element is pivotably connected around a first pivot axis to the assembly plate and is pivotably connected around a second pivot axis to the attachment part.

2. The assembly adaptor according to claim 1, wherein the two pivot axes are arranged parallel to each other.

3. The assembly adaptor according to claim 1, wherein the attachment faces are arranged parallel to one another in the assembled condition of the assembly adaptor and with a distance to each other.

4. The assembly adaptor according to claim 1, wherein a third attachment face is formed on the assembly plate, said third attachment face is arranged at a right angle to the first attachment face and in the assembled condition of the assembly adaptor, the third attachment face is held in abutment with the frame.

5. The assembly adaptor according to claim 1, wherein an additional plate is provided that is detachably connected to the assembly plate.

6. The assembly adaptor according to claim 5, wherein the additional plate has a fourth attachment face that is arranged on one plane with the first attachment face and in the assembled condition of the assembly adaptor, said fourth attachment face is held in abutment with the frame.

7. The assembly adaptor according to claim 1, wherein the assembly plate and the attachment part are formed parts from sheet metal.

8. A cabinet body with an assembly adaptor according to claim 1;

the assembly plate is connected to the frame and the first attachment face, facing inwards, is held in abutment to a first inner face of the frame;

the attachment part is connected to the side wall and the second attachment face is held in abutment with a second inner face of the side wall, arranged parallel and with a distance to the first inner face.

9. The cabinet body according to claim 8, wherein an additional plate is provided for the assembly of a further component of a functional mounting, said additional plate detachably connected to the assembly plate and said additional plate is connected to the frame and the fourth attachment face is held in abutment to the first inner face of the frame.

10. The cabinet body according to claim 8 wherein a functional mounting is attached to the assembly face of the assembly plate.

11. The cabinet body according to claim 8 wherein the assembly face is arranged parallel to the second inner face of the side wall.

* * * * *

UNITED STATES PATENT AND TRADEMARK OFFICE

CERTIFICATE OF CORRECTION

PATENT NO. : 8,333,445 B2
APPLICATION NO. : 12/428725
DATED : December 18, 2012
INVENTOR(S) : Juergen Schnell It is certified that error appears in the above-identified patent and that said Letters Patent is hereby corrected as shown below:

Delete Title Page, and substitute with attached Title Page.

In the Drawings:
Please add Sheet 11 of 11 (showing FIGS. 11A-11D).

Signed and Sealed this
Thirteenth Day of May, 2014

Michelle K. Lee

Michelle K. Lee
*Deputy Director of the United States Patent and Trademark Office*

(12) United States Patent
Schnell

(10) Patent No.: US 8,333,445 B2
(45) Date of Patent: Dec. 18, 2012

(54) ASSEMBLY ADAPTOR

(75) Inventor: Juergen Schnell, Lohmar (DE)

(73) Assignee: Huwil Butoripari Es Uzletberendezesi Rendszerek Kft, Budapest (HU)

( * ) Notice: Subject to any disclaimer, the term of this patent is extended or adjusted under 35 U.S.C. 154(b) by 497 days.

(21) Appl. No.: 12/428,725

(22) Filed: Apr. 23, 2009

(65) Prior Publication Data

US 2009/0267473 A1 Oct. 29, 2009

(30) Foreign Application Priority Data

Apr. 25, 2008 (DE) ..... 20 2008 005 795 U

(51) Int. Cl.
*A47B 97/00* (2006.01)

(52) U.S. Cl. ..... 312/327

(58) Field of Classification Search ..... 312/294, 312/326, 327, 328, 329, 352, 265; 16/365, 16/366, 382, 82; 248/214, 276.1, 284.1
See application file for complete search history.

(56) References Cited

U.S. PATENT DOCUMENTS

| | | | | |
|---|---|---|---|---|
| 4,485,524 | A * | 12/1984 | Neville | 16/241 |
| 5,079,797 | A * | 1/1992 | Ohshima et al. | 16/82 |
| 5,117,587 | A * | 6/1992 | Doan | 49/495.1 |
| 6,877,830 | B2 * | 4/2005 | Salice | 312/327 |
| 2009/0261696 | A1 * | 10/2009 | Hollenstein et al. | 312/327 |

* cited by examiner

*Primary Examiner* — James O Hansen
(74) *Attorney, Agent, or Firm* — Harness, Dickey & Pierce, P.L.C.

(57) ABSTRACT

An assembly adaptor (6) for the assembly of a functional mounting (19) that is attachable on a cabinet body (1) with a frame (2) structure has an assembly plate (7) with an assembly face (14) on which the functional mounting (19) is attached. A first attachment face (9), in the mounted condition of the assembly adaptor (6), is held in abutment to a frame (2) of a cabinet body (1). An attachment part (8) with a second attachment face (10), in the assembled condition of the assembly adaptor (6), is held in abutment to a side wall (3) of the cabinet body (1). The attachment portion (8) is retainable relative to the assembly plate (7) with a variable distance between the two attachment faces (9, 10).

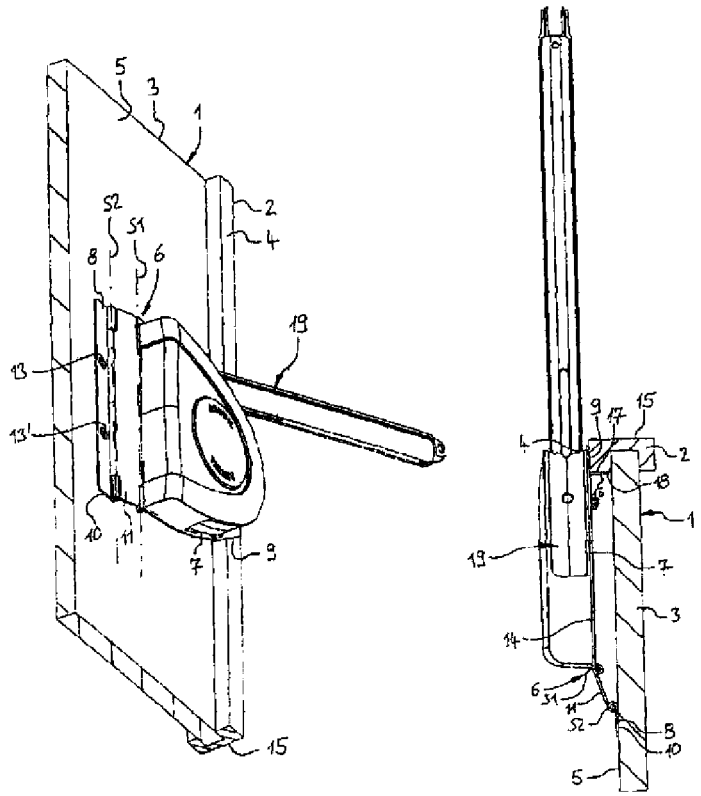

11 Claims, 11 Drawing Sheets